US009371689B2

(12) United States Patent
Licciardi Di Stefano

(10) Patent No.: US 9,371,689 B2
(45) Date of Patent: Jun. 21, 2016

(54) BLIND SYSTEM

(75) Inventor: Carmelo Joseph Licciardi Di Stefano, Broadmeadows (AU)

(73) Assignee: ACMEDA PTY LTD ACN (AU)

( * ) Notice: Subject to any disclaimer, the term of this patent is extended or adjusted under 35 U.S.C. 154(b) by 205 days.

(21) Appl. No.: 12/858,538

(22) Filed: Aug. 18, 2010

(65) Prior Publication Data

US 2011/0100570 A1 May 5, 2011

(30) Foreign Application Priority Data

Oct. 29, 2009 (AU) ..... 2009905294

(51) Int. Cl.
*E06B 9/58* (2006.01)
*E06B 9/42* (2006.01)

(52) U.S. Cl.
CPC .. *E06B 9/581* (2013.01); *E06B 9/42* (2013.01)

(58) Field of Classification Search
CPC ..... E06B 9/13; E06B 9/58; E06B 9/581
USPC ..... 160/273.1, 238, 266, 268.1, 270, 271, 160/272, 239, 31, 66, 85, 87
See application file for complete search history.

(56) References Cited

U.S. PATENT DOCUMENTS 1,959,136 A * 5/1934 Miller ..... 160/268.1
3,292,685 A * 12/1966 Clark ..... 160/26
4,478,268 A * 10/1984 Palmer ..... 160/310
4,638,844 A * 1/1987 Hayashiguchi ..... 160/23.1
4,736,785 A * 4/1988 Seuster ..... 160/264
4,738,296 A * 4/1988 Hatch ..... 160/133
4,759,396 A * 7/1988 Quinn ..... 160/66
5,253,694 A * 10/1993 Bernardo ..... 160/133
5,332,021 A * 7/1994 Todd et al. ..... 160/133
5,839,493 A * 11/1998 Quasius ..... 160/133
6,095,224 A * 8/2000 Miller ..... 160/133
6,095,225 A * 8/2000 Miller ..... 160/133
6,119,758 A * 9/2000 Coenraets ..... 160/273.1
6,260,601 B1 * 7/2001 Thomas ..... 160/133
6,302,179 B1 * 10/2001 Miller ..... 160/23.1
6,394,173 B2 * 5/2002 Enssle ..... 160/273.1
6,453,975 B2 * 9/2002 Miller ..... 160/315
6,631,749 B1 * 10/2003 Zabala ..... 160/133
6,715,529 B2 * 4/2004 Farooq ..... 160/133

(Continued)

FOREIGN PATENT DOCUMENTS

AU 598354 6/1990
AU 2009212839 3/2010

(Continued)

*Primary Examiner* — Katherine Mitchell
*Assistant Examiner* — Shiref Mekhaeil
(74) *Attorney, Agent, or Firm* — Hahn, Loeser & Parks, LLP; Arland T. Stein; Brian V. Finch

(57) ABSTRACT

A blind system, including a screen with one end secured to a bar; and a guide track on opposite edges of said screen, each said guide track having a single rigid longitudinal body defining a guide channel with discrete parallel first and second channel portions; wherein, said screen has a edge portion extending through the second channel portion, a slit formed along said body, and into said first channel portion, for guiding the movement of said screen along said slit and for resisting separation of said edge portion from said first channel portion, and wherein said bar has an end portion adapted for movement only within said second channel portion for guiding said bar to move along said body.

18 Claims, 5 Drawing Sheets

(56) References Cited

U.S. PATENT DOCUMENTS

| | | | | |
|---|---|---|---|---|
| 6,951,236 | B2 * | 10/2005 | Schlater et al. | 160/133 |
| 7,357,171 | B2 * | 4/2008 | Miller | 160/235 |
| 7,413,000 | B2 * | 8/2008 | Lin | 160/310 |
| 7,516,770 | B2 * | 4/2009 | Jerry | 160/267.1 |
| 7,748,431 | B2 * | 7/2010 | Jansen et al. | 160/268.1 |
| D631,171 | S * | 1/2011 | Konrad | D25/48.4 |
| 8,109,317 | B2 * | 2/2012 | Bostyn | 160/273.1 |
| 8,291,960 | B2 * | 10/2012 | Bowman | 160/267.1 |
| 8,490,670 | B2 * | 7/2013 | Miller | 160/133 |
| 2002/0062930 | A1 * | 5/2002 | Jennings | 160/89 |
| 2004/0144498 | A1 * | 7/2004 | Hudoba et al. | 160/31 |
| 2005/0082020 | A1 * | 4/2005 | Miller | 160/264 |
| 2005/0205221 | A1 * | 9/2005 | Miller | 160/236 |
| 2007/0006980 | A1 * | 1/2007 | Zabala et al. | 160/133 |
| 2007/0175603 | A1 * | 8/2007 | Lin | 160/273.1 |
| 2011/0061817 | A1 * | 3/2011 | Smith | 160/121.1 |
| 2012/0267058 | A1 * | 10/2012 | Smith | 160/121.1 |

FOREIGN PATENT DOCUMENTS

| | | |
|---|---|---|
| JP | 9303068 | 11/1997 |
| JP | 2000303781 | 10/2000 |
| JP | 2004176473 | 6/2004 |

* cited by examiner

BLIND SYSTEM

CROSS-REFERENCE TO RELATED APPLICATIONS

This application claims priority to Australian provisional patent application number 2009905294, filed on Oct. 29, 2009, and titled A BLIND SYSTEM, which is included herein by reference.

FIELD

The field relates to track guided blind systems for extending and retracting a screen.

BACKGROUND

A blind system typically includes a screen (which refers to a flexible, semi-rigid or rigid sheet of material such as canvas, fabric, mesh or a panel) with one end secured to and/or gathered by a rotatable roller, and another end secured to a draw bar. A screen may also be referred to as a curtain, awning or shade. The roller may be secured to a supporting frame, structure or surface. The roller rotates in one direction to extend the screen over an area or opening to be covered (e.g. a wall or window), and rotates in the other direction to retract the screen. The sides of the screen may hang freely when extended.

When a blind system is used in windy or air turbulent environments (such as for covering an opening window, skylight or in outdoor environments), the turbulence may cause the screen to vibrate and cause damage to the screen itself or to surrounding items. For example, a screen hanging freely over a window may flap violently when a strong gust of wind enters or passes the window. The screen and draw bar may strike or damage items and injure people in close proximity to the window.

Several attempts have been made to address this issue. Australian patent no. 2002300183 describes a track guided blind system where the edges of a screen extend through a slot of a respective guide track and then into an internal cavity of the guide track. The edge of the screen receives a cord (or rope) to make the edge larger in diameter than the size of the slot. The screen can therefore slide along the guide track with its edges securely retained in the cavity. The screen is installed taut so that there would be little or no flapping of the screen in windy conditions. The ends of the draw bar are adapted to fit into (and slide along) the slot of the guide track. There are several problems with this approach. The draw bar has much greater thickness than the screen. If the slot is sufficiently large to receive an end of the draw bar, the screen will be able to move within the slot (i.e. from one edge of the slot to the other) and can therefore flap in windy conditions. However, if the slot is sufficiently small so that the edges of the slot are close to the surface of the screen, then the end of the draw bar will need to be made very thin, which would be structurally weak and therefore prone to damage. Further, when the screen is stretched, there will be greater frictional resistance between the edge of the screen and the inside of the internal cavity, thus making it harder to extend and retract the screen along the guide track. Also, stretching the screen for extended periods causes the screen to gradually lose its elastic characteristics, and therefore be less effective in resisting flapping in windy conditions (since the guide tracks will be fixed in position when installed).

Australian patent no. 598354 describes another blind system where the edge of a screen extends through a slot of a guide track and adapted to be securely received inside a longitudinal channel of the guide track. The blind system has cushioning materials for biasing the guide track away from the screen and thus keeping the screen tightly stretched. When the blind system is initially installed, the guide tracks are positioned so as to stretch the screen, and in this configuration, the cushioning materials will be slightly compressed. Over time, as slack develops in the screen, the cushioning materials decompress to provide a biasing force that urges the guide tracks away from the screen thereby maintaining tension in the screen. However, the need to have cushioning materials increases the mechanical complexity of the system.

It is therefore desired to address one or more of the above problems, or to at least provide a useful alternative.

SUMMARY

In a described embodiment, there is provided a blind system, including:

a screen with one end secured to a bar; and a guide track on opposite edges of said screen, each said guide track having a single rigid longitudinal body defining a guide channel with discrete parallel first and second channel portions;

wherein, said screen has an edge portion extending through the second channel portion, a slit formed along said body, and into said first channel portion, for guiding the movement of said screen along said slit and for resisting separation of said edge portion from said first channel portion, and wherein said bar has an end portion adapted for movement only within said second channel portion for guiding said bar to move along said body.

BRIEF DESCRIPTION OF THE DRAWINGS

Representative embodiments of the present invention are herein described, by way of example only, with reference to the accompanying drawings, wherein.

DETAILED DESCRIPTION OF THE REPRESENTATIVE EMBODIMENTS

Figure 1:
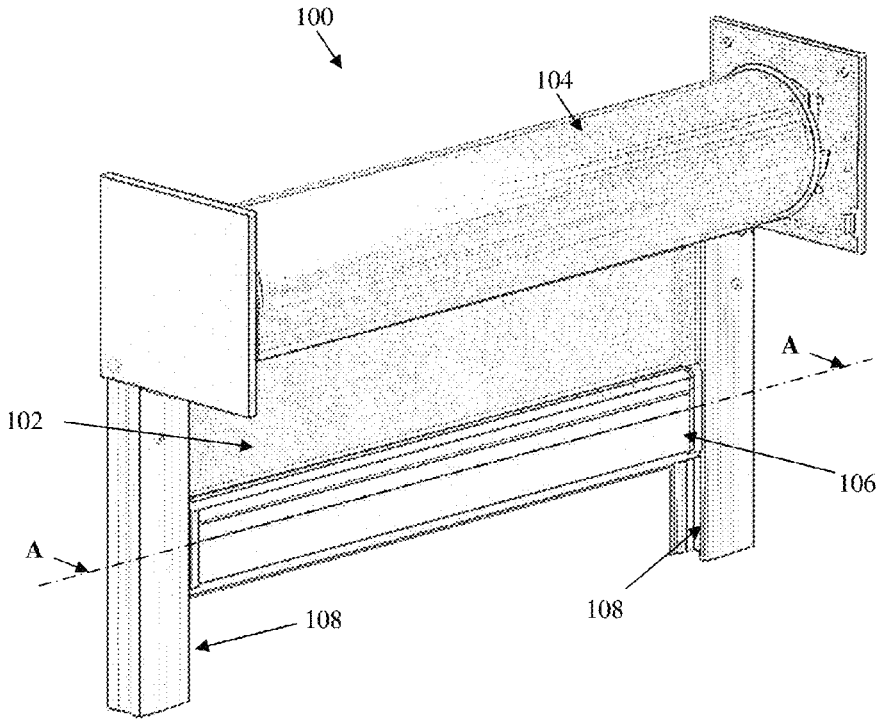
FIG. 1 shows the main components of a blind system.

A blind system 100, as shown in FIG. 1, includes a screen 102 with one end secured to a rotatable roller 104 and another end secured to a bar 106. The roller 104 rotates in one direction to extend the screen 102 over an area or opening of a building or equipment (e.g. a wall, window or skylight), and rotates in the other direction to retract the screen 102. The guide tracks 108 guide the movement of the screen 102 and bar 106 during extension and retraction. The roller 104 and the guide tracks 108 may be secured to a supporting frame, structure or surface. The screen 102 can be any flexible or rigid sheet material (e.g. canvas, fabric, wire or plastic mesh, or a panel) suitable for use as a cover.

Figure 2:
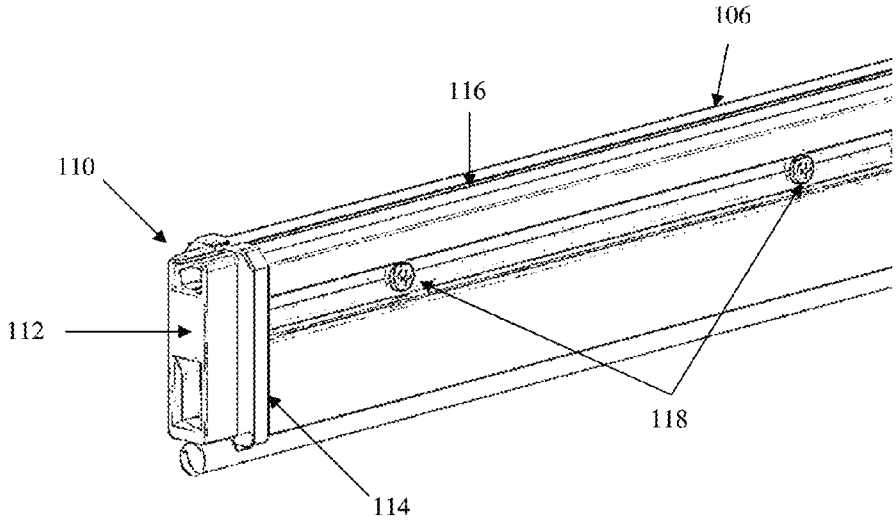
FIG. 2 shows an end portion of a bar secured to the screen of the system.

FIG. 2 shows the bar 106 in greater detail. An end portion 110 of the bar 106 has a guide portion 112 that is shaped to be received in a channel portion 124 (see FIG. 3) of the guide track 108. The flanged portion 114 floats on the outside the guide track 108. The bar 106 also has a slot 116 that is adjustable to an open position (e.g. by turning one or more fasteners 118) for receiving an end of the screen 102. The slot 116 is adjustable to a closed position (e.g. by turning one or more fasteners 118) to form a secure engage between the bar 106 and end portion of the screen 102 so as to resist detachment from each other. The bar 106 may have sufficient weight to apply a downward force (due to gravity) to one end of the screen 102. For applications where gravity does not play a role (e.g. skylights), the bar 106 may be pulled by other mechanical means (e.g. wire ropes secured to another rotatable roller). The extension and retraction of the screen 102 may be mechanically triggered by pulling the bar 106, or by operating a separate controller (mechanical or electrical) that operates a mechanical drive device for driving the rotation of the roller 104 in a screen extending or screen retracting direction.

Figure 3:
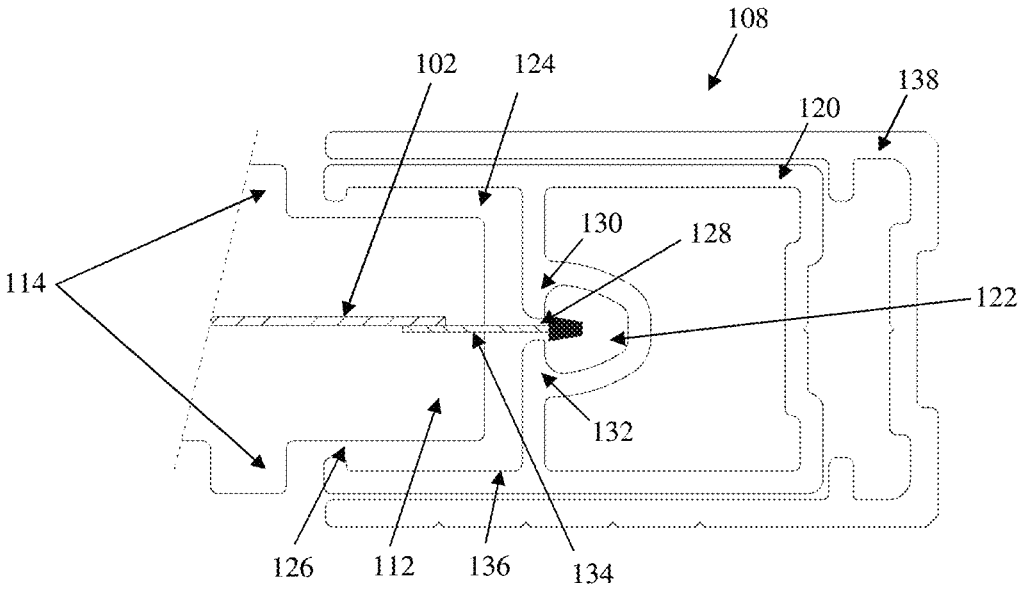
FIG. 3 is a sectional view of a guide track in one embodiment of the system.

FIG. 3 shows a sectional view of a guide track 108 (along section A-A in FIG. 1) for use in one representative embodiment of the system 100. The guide track 108 includes a single rigid body 120 that may be made as one piece. The guide track 108 may include only the body 120 or 300 (as described below), or a combination of the body 120 or 300 with one or more other components (e.g. a U-shaped housing 138 and/or a bracket member 142 or 144). In a representative embodiment, the body 120 is extruded from a rigid material (e.g. including a metal such as aluminium, or a polymer such as polyvinyl chloride (PVC)). The body 120 defines a guide channel for guiding the movement of the screen 102 and bar 106 during extension and retraction of the screen 102. The guide channel has a single longitudinal recess formed along the body 120, and is divided into a first channel portion 122 and a second channel portion 124. The first and second channel portions 122 and 124 each corresponds to a different (or discrete) longitudinal column of space defined along the body 120, and the first and second channel portions 122 and 124 are aligned in parallel to each other.

The body 120 also defines a longitudinal opening 126 that opens into the second channel portion 124. A slit 128 is defined to provide access to the first channel portion 122 from the second channel portion 124. The slit 128 may be defined by one or more barrier members 130 and 132 protruding into the guide channel. In a representative embodiment, the guide channel is defined by a continuous wall section 136 of the guide track 108.

Figure 3A:
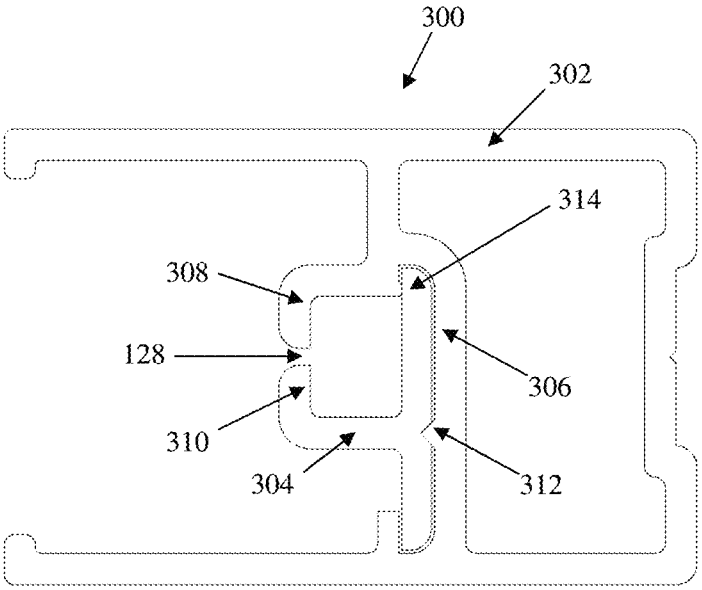
FIG. 3A is a sectional view of a body for use in another embodiment of the system.

FIG. 3A shows a sectional view of another body 300 for use as (or as part of) a guide track 108 of another representative embodiment of the system 100. The body 300 is assembled from two separate pieces, referred to as a first member 302 and a second member 304. The first member 302 is shaped for securely coupling with the second member 304. For example, in the representative embodiment shown in FIG. 3A, the first member 302 has a recess 306 shaped for engaging an outer surface of the second member 304 to resist separation from each other 302 and 304. The first and second members 302 and 304 may be coupled together in other ways.

The first and second member 302 and 304 may each define a different respective barrier member 308 and 310 that defines the slit 128. The first member 302 may include one or more support portions 314 (e.g. in the form of projecting padded areas) for supporting different respective end portions of the second member 304 for correct lateral alignment of the barrier members 308 and 310. The support portions 314 can help ensure that the barrier members 308 and 310 are aligned to be directly opposite to each other, and help avoid a situation where one of the barrier members 308 and 310 is positioned slightly in front or behind of the other barrier member (which affects the smoothness of the screen 102 moving along the slit 128).

The first and second members 302 and 304 are also adapted so that, when the members 302 and 304 are coupled together, the engagement formed between the members 302 and 304 resist movement towards or away from each other. This resists the clearance of the slit 128 from becoming too small (and jam with the screen 102) or too large (and enable the screen 102 to escape from the first channel portion 122) as the first and second members 302 and 304 respectively move towards or away from each other. For example, in the representative embodiment shown in FIG. 4, the first member 302 includes a rib 312 that protrudes into a corresponding recess formed in the second member 304. It will be understood that the first and second members 302 and 304 may engage with each other (in the manner set out above) in other ways.

As shown in FIG. 3, the guide portion 112 of the bar 106 is received into the second channel portion 124. The guide portion 112 of the bar 106 is adapted for movement only within the second channel portion 124, so that the second channel portion 124 guides the bar 106 to move (or slide) along the longitudinal opening 126 of the guide track 108.

As shown in FIG. 3, the screen 102 has a side portion 134 (also referred to as an edge portion) adapted to extend through the second channel portion 124, the slit 128 formed along the guide track 108, and then extend into the first channel portion 122. The side portion 134 is also adapted so that the screen 102 is able to move (or slide) along the first channel portion 122, and also adapted so that the side portion 134 is securely received within the first channel portion 122 to resist separation of the side portion 134 from the first channel portion 122. For example, a peripheral part of the side portion 134 (which is received within the first channel portion 122) may be adapted to have a greater size or diameter than the clearance (or size of the opening) of the slit 128 to resist the side portion 134 from being pulled out of the first channel portion 122 via the slit 128.

In a representative embodiment, the peripheral part of the side portion 134 is made of a flexible material (e.g. a polymer-based material) with a low frictional coefficient relative to the material on the surface of the first channel portion 122, to which the peripheral part of the side portion 134 comes into contact (e.g. the surface of the body 120, or any coating or substance applied thereon such as Teflon or silicon).

Figure 7:
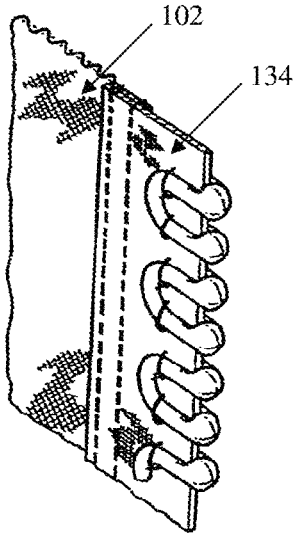
FIG. 7 shows an end portion of the screen in a representative embodiment.

In a representative embodiment, the peripheral part of the side portion 134 is one side of a zipper, which is typically used as a fastener in clothing. The zipper side portion 134 may be sewn, glued or otherwise secured to the screen 102 (as shown in FIGS. 3 and 7). It should be noted that the screen 102 includes a sheet of material together with any other components attached or secured to that sheet of material (e.g. one or more zippers).

In a representative embodiment, the clearance of the slit 128 (i.e. the gap between the edges of the body 120 that define the slit 128) is sufficiently small so that the respective edges defining the slit 128 are in close proximity to (e.g. just shy of touching) the surface of the screen 102 passing through the slit 128. However, the clearance of the slit 128 is wide enough to allow the screen 102 to move through (or slide along) the slit 128. In a representative embodiment, the slit 128 has a clearance of between 0.7 millimeters and 2.0 millimeters inclusive, which corresponds to an average thickness of materials that may be selected for use as a screen 102.

Figure 4:
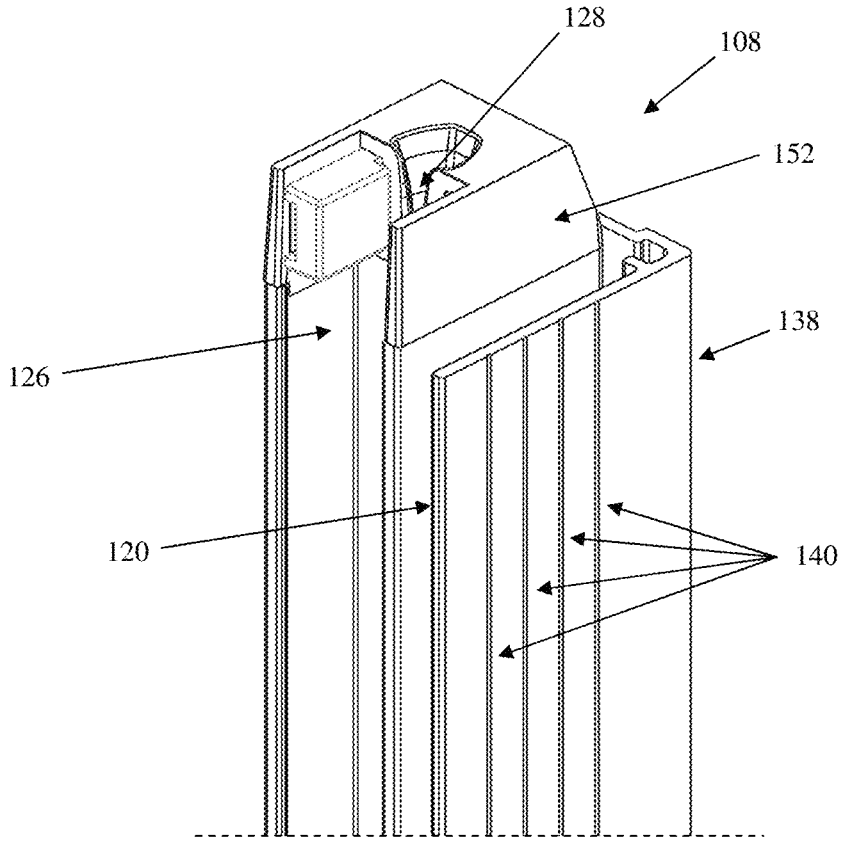
FIG. 4 is a perspective view of the body fitted within a U-shaped housing.
Figure 8:
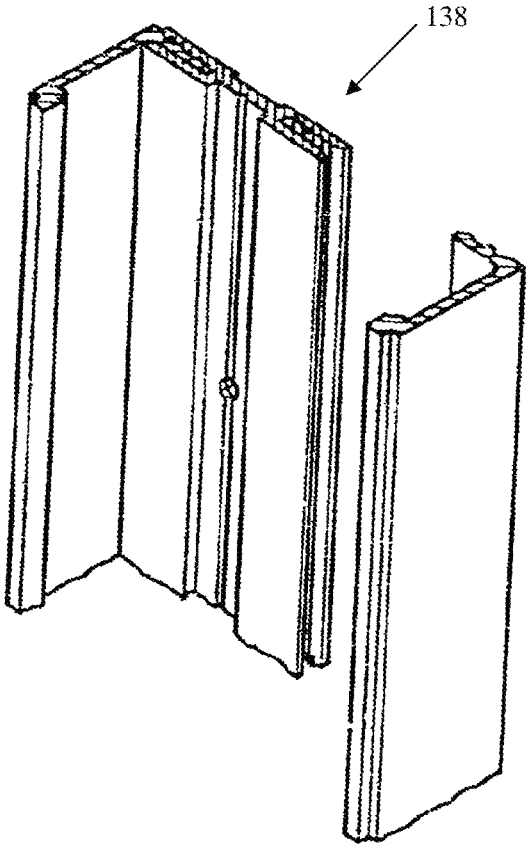
FIG. 8 shows another representative embodiment of a support bracket.

As shown in FIG. 4, the body 120 can be fitted into a U-shaped housing 138. The U-shaped housing 138 may be fixed to a supporting structure or surface (e.g. a wall or window frame). The body 120 is adjustably positioned within a recessed portion of the U-shaped housing 138 to ensure that sufficient tension is applied to the screen 102 (e.g. by stretching it taut, but not too much as to inhibit smooth sliding). The U-shaped housing 138 may include one or more longitudinal recesses or grooves 140. The recesses or grooves 140 help align a fastener (e.g. a rivet) being driven through the U-shaped housing 138 to secure the body 120 and housing 138 together. The U-shaped housing may be made as one piece (as shown in FIG. 4), or alternatively, may be made up of several pieces assembled together (as shown in FIG. 8). An end piece 152 may be fitted to the end of the body 120 for guiding the side portion 134 of the screen 102 into the second channel portion 122. For example, the end piece 152 shown in FIG. 4 the two opposing sides of the slit 128 are spaced wider apart at an outward facing end of the end piece 152 and funnels towards the predefined clearance of the slit 128 at the inward facing end of the end piece 152. The end piece 152 may be made of a rigid material (e.g. plastic or metal).

Figure 5:
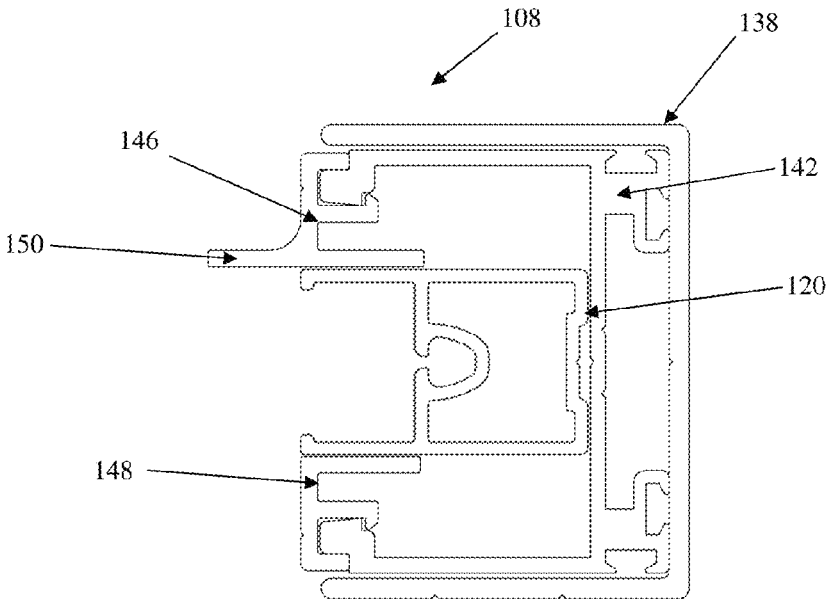
FIG. 5 is a sectional view of the body fitted to a support bracket.
Figure 6:
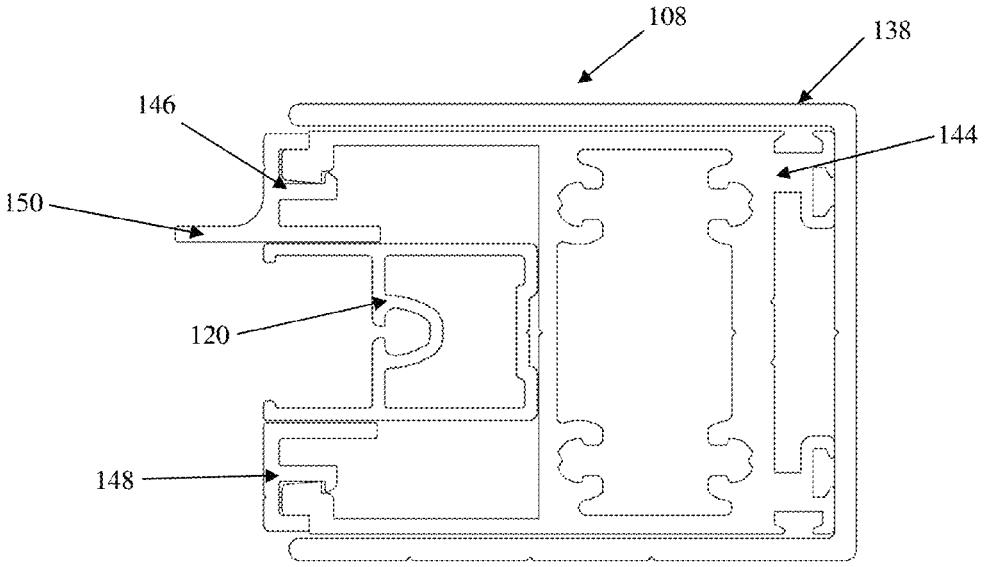
FIG. 6 is a sectional view of the body fitted to another support bracket.

FIGS. 5 and 6 show a sectional view of a representative embodiment where the body 120 may be fitted to a bracket member 142 and 144, which is then fitted to the U-shaped housing 138. In other representative embodiments, the body 300 (or a body of other suitable design) may be used instead of body 120. The body 120 may be held in position relative to the bracket member 142 and 144 by one or more support members 146 and 148 placed next to the body 120. A support member 146 may be adapted to include a flanged portion 150, which helps deflect wind that flows towards the body 120 and thus helps minimise the severity of the factors that may cause the screen 102 to vibrate.

A key advantage of providing a guide track 108 with a body 120 in the form of a single piece is that it is simpler (and therefore cost effective) to manufacture. The body 120 or 300 is supplied in one piece, but can be made from one or several pieces (e.g. 302 and 304) during manufacture, and can be used immediately. Another advantage is that the guide track 108 can (at the same time) receive and hold onto the edges 134 of the screen 102, as well as the end portions 110 of a bar 106, so as to minimise the lateral movement of these parts 102 and 106 in a direction perpendicular to the extension and retraction direction of the screen 102. This minimises the risk of damaging the screen 102, bar 106 or adjacent items that may otherwise be struck by the screen 102 or bar 106 as a result of excessive or intense lateral movement.

It can also be difficult to manufacture a body 120 having a slit 128 with a very small clearance (e.g. just shy of touching the screen 102) but yet provide sufficient structural strength. Although metallic materials are generally difficult to shape, especially when a high degree of precision is required, the provision of the two different (or discrete) parallel first and second channel portions 122 and 124 make it easier to form a small clearance slit 128 by way of extrusion. The parallel first and second channel portions 122 and 124 also provide the advantages of being able to receive, guide and retain both the bar 106 and the screen 102 at the same time, as described above. When higher degrees of precision are required, the body 300 can be manufactured from two or more members 302 and 304 that are respectively shaped to define a very small clearance when the members 302 and 304 are fitted together, and which can still provide all of the functionality and advantages of a body 120 made as one piece.

Modifications and improvements to the invention will be readily apparent to those skilled in the art. Such modifications and improvements are intended to be within the scope of this invention.

In this specification, including the background section, where a document, act or item of knowledge is referred to or discussed, this reference or discussion is not an admission that the document, act or item of knowledge or any combination thereof was at the priority date, publicly available, known to the public, part of common general knowledge, or known to be relevant to an attempt to solve any problem with which this specification is concerned.

What is claimed is:

1. A blind system, including:

a screen with opposite edge portions extending along edges of the screen and defining a screen surface plane therebetween, and one end portion secured to a bar; and a guide track on each said opposite edge portions of said screen, each said guide track having a single rigid longitudinal body forming a guide channel with discrete first and second channel portions and a slit formed along said body between the first and second channel portions;

at least one of said opposite edge portions extending through the second channel portion and into said first channel portion, adapted to guide the movement of said screen along said slit and adapted to resist separation of the at least one of said opposite edge portions from said first channel portion, said bar having a guide portion at the end of the bar adapted for movement only within said second channel portion to guide said bar to move along said body, the guide portion being wider than the screen in a direction transverse to the screen surface plane, wherein the opposite edge portions are retractable and wherein each edge portion has a cross-sectional size greater than a clearance of said slit so that said edge portion resists separation of said screen from said first channel portion.

2. The system as claimed in claim 1, where said guide channel comprises a single longitudinal recess formed in said body, and said first and second channel portions are defined by a continuous wall section of said body.

3. The system as claimed in claim 1, where said body is extruded from a rigid material, and said slit provides access to said first channel portion from said second channel portion.

4. The system as claimed in claim 1, where said guide channel comprises a single longitudinal recess formed in said body, said first and second portions are defined by a continuous wall section of said body, said body is extruded from a rigid material, and said slit provides access to said first channel portion from said second channel portion.

5. A system as claimed in claim 1, wherein said slit is defined between two barrier members, said barrier members being positioned sufficiently close to respective front and back surfaces of said screen so as to: (i) allow said screen to slide along said slit, and (ii) minimize lateral movement of said screen between respective edges of said slit.

6. A system as claimed in claim 5, wherein said slit has a clearance between 0.7 and 2.0 millimeters inclusive.

7. A system as claimed in claim 1, wherein said edge portion includes a peripheral portion located within said first channel portion, said peripheral portion having a cross-sectional size greater than a clearance of said slit so that said peripheral portion resists separation of said screen from said first channel portion.

8. A system as claimed in claim 7, wherein said peripheral portion comprises one side of a zipper secured to said screen.

9. A system as claimed in claim 1, wherein said edge portion is secured to said screen.

10. A blind system comprising:

a cross bar;

a screen comprising opposite edge portions extending along opposite edges of the screen and defining a screen surface plane therebetween, and an end portion secured to the cross bar; and a guide track on opposite edge portions of said screen, each said guide track having a single rigid longitudinal body forming a guide channel, the guide channel comprising a screen guide portion adapted to guide the movement of said screen and adapted to resist separation of the screen edge portion from the screen guide portion, a cross bar guide portion adapted to guide the movement of said cross bar, and a slit formed along the guide channel between the screen guide portion and the cross bar guide portion, wherein the slit is adapted to resist separation of the screen edge portion from the screen guide portion;

wherein each opposite edge portion of the screen extends through the cross bar guide portion, through the slit and into the screen guide portion, and wherein end portions of the cross bar are wider than the screen in a direction transverse to the screen surface plane and extend only into the cross bar guide portion and do not extend into the slit or the screen guide portion.

11. The blind system as claimed in claim 10, where said guide channel comprises a single longitudinal recess formed in said body, and said screen guide portion and said cross bar guide portion are defined by a continuous wall section of said body.

12. The blind system as claimed in claim 10, where said body is extruded from a rigid material, and said slit provides access to said screen guide portion from said cross bar guide portion.

13. The blind system as claimed in claim 10, where said guide channel comprises a single longitudinal recess formed in said body, said screen guide portion and said cross bar guide portion are defined by a continuous wall section of said body, said body is extruded from a rigid material, and said slit provides access to said screen guide portion from said cross bar guide portion.

14. The blind system as claimed in claim 10, wherein said slit is defined between two barrier members, said harrier members being positioned sufficiently close to respective front and back surfaces of said screen so as to: (i) allow said screen to slide along said slit, and (ii) minimize lateral movement of said screen between respective edges of said slit.

15. The blind system as claimed in claim 14, wherein said slit has a clearance between 0.7 and 2.0 millimeters inclusive.

16. The blind system as claimed in claim 10, wherein said edge portion includes a peripheral portion located within said screen guide portion, said peripheral portion having a cross-sectional size greater than a clearance of said slit so that said peripheral portion resists separation of said screen from said first channel portion.

17. The blind system as claimed in claim 16, wherein said peripheral portion comprises one side of a zipper secured to said screen.

18. The blind system as claimed in claim 10, wherein said edge portion is secured to said screen and wherein said edge portion has a cross-sectional size greater than a clearance of said slit so that said edge portion resists separation of said screen from said screen guide portion.

* * * * *